United States Patent [19]

Pieper

[11] 4,208,899

[45] Jun. 24, 1980

[54] PRESS FOR PRODUCING MACHINE ELEMENTS, ESPECIALLY BALLS, RIVETS AND THE LIKE

[75] Inventor: Wilhelm Pieper, Wuppertal, Fed. Rep. of Germany

[73] Assignee: Gebr. Hilgeland, Wuppertal, Fed. Rep. of Germany

[21] Appl. No.: 855,954

[22] Filed: Nov. 29, 1977

[30] Foreign Application Priority Data

Nov. 22, 1976 [DE] Fed. Rep. of Germany ..... 2653040

[51] Int. Cl.[2] ..... B21D 45/00

[52] U.S. Cl. ..... 72/344; 72/352; 72/452

[58] Field of Search ..... 72/344, 352, 452; 83/618, 628, 519

[56] References Cited

U.S. PATENT DOCUMENTS

| | | | |
|---|---|---|---|
| 3,064,507 | 11/1962 | Strugala | 72/344 |
| 3,538,735 | 11/1970 | Zimmerman | 72/452 |
| 3,747,452 | 7/1973 | Konstanlinerich | 83/618 X |
| 3,850,494 | 11/1974 | Rebendorf | 72/452 |

*Primary Examiner*—Leon Gilden

*Attorney, Agent, or Firm*—Becker & Becker, Inc.

[57] ABSTRACT

A press for producing machine elements, such as balls, rivets and the like, especially machine elements of relatively small dimensions, e.g. balls having a diameter of 1 mm, from wire sections, which includes a wire intake device, a device for shearing off the wire, a device for conveying the wire sections to and in front of a stationary matrix, and a punch associated with the matrix and adapted to be reciprocated back and forth in axial direction with regard to the matrix. If desired, there may also be provided ejectors for the punch or the matrix. The punch is, axially with regard to the matrix, movably guided in a tool carrier which in pressing direction is stationarily arranged in the machine frame. Furthermore, the punch is drivingly connected to a rotatable cam disc through the intervention of a pick-up roller.

15 Claims, 9 Drawing Figures

60
62
64
10
61
9
67
57
59
55
12
41
43
47
4
65
5
1
63
42
46
40
54
90
58
11
56
15
16
66

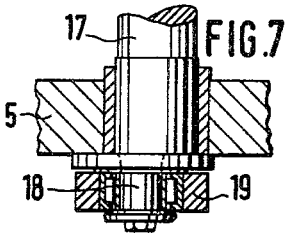
FIG.7
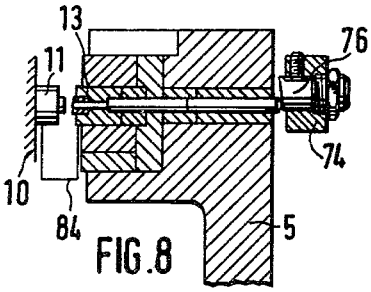
FIG.8
FIG.9
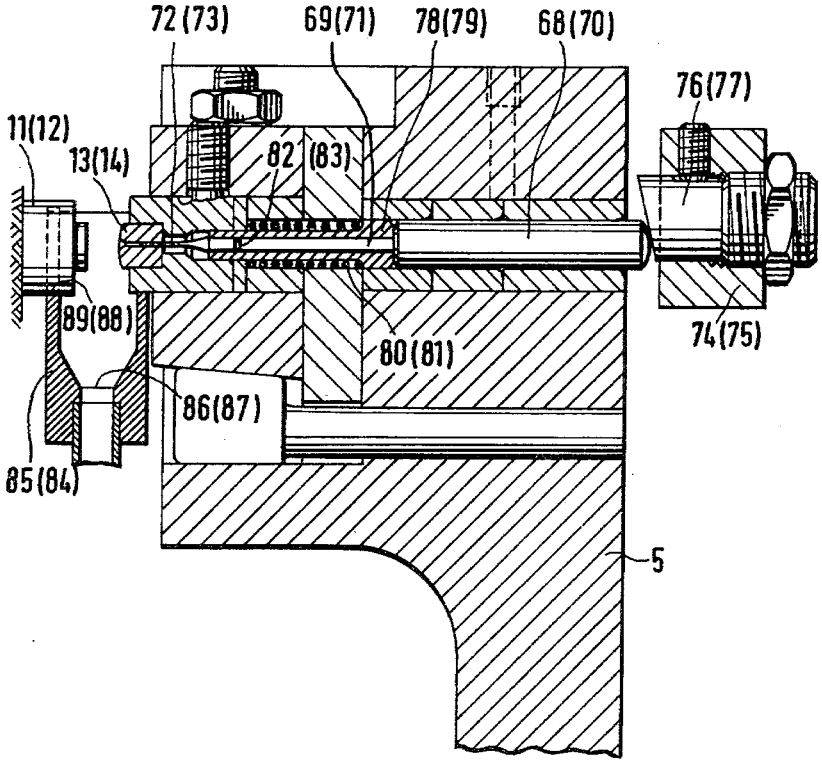

PRESS FOR PRODUCING MACHINE ELEMENTS, ESPECIALLY BALLS, RIVETS AND THE LIKE

The present invention relates to a press for manufacturing machine elements such as balls, rivets and the like. For purposes of making machine elements such as balls, rivets and the like, especially machine elements of relatively small dimensions as for instance balls with a diameter of 1 mm, it is known to employ presses which operate according to the single type pressure or double type pressure method which are provided with a reciprocable press carriage and if necessary also with a reciprocable punch carrier. Such presses have a wire intake, a shearing device for the wire, a device for transporting the wire sections to and in front of a stationary matrix which has associated therewith a punch reciprocable axially with regard to the matrix. Such presses may also be provided with an ejector for the punch and/or the matrix. The press carriage of these known presses is drivingly connected with an eccentric shaft or the like. In view of this drive arrangement, practically no staying time of the punch or punches in a certain position in front of the matrix is obtainable. This, however, would be desirable so that sufficient time will be available for the movement of the transporting device and the shearing device out of the range of movement of the press carriage prior to the pressing operation. Therefore, with heretofore known presses of this type, it is necessary by means of a particularly designed drive to provide for an extremely fast return movement of the transporting device for the wire sections or the shearing-off device from the range of movement of the press punch or press punches and of the entire press carriage.

In view of the considerable masses which with these known presses move back and forth and which are primarily due to the press carriage, the output of these known presses is rather limited.

Furthermore, these heretofore known presses have the considerable drawback that precisely when adjusting the tools of the press for the manufacture of machine elements of relatively small dimensions, for instance balls with a diameter of 1 mm, an undue increased time consumption is unavoidable over the adjustment of tools for pressing larger machine elements.

For purposes of producing balls, especially such with relatively small diameter, a still further method has become known. According to this last mentioned method, sections are sheared off or cut off from a wire and are subsequently one after another rolled, rough ground, hardened, honed, and finally polished. With these heretofore known manufacturing methods, the rolling and rough grinding operations consume considerable time. Furthermore, with these methods considerable losses in material and in undue wear of the tools has to be put up with. the considerable losses in material are due to the fact that the volume of the sheared off or cut off wire sections must have about 2.8 times the volume of the finished balls. Aside from the correspondingly high time consumption for the rolling and rough grinding steps, also the considerable tool wear will be appreciated inasmuch as considerable quantities of material have to be transformed and taken off.

It is, therefore, an object of the present invention to provide a press for manufacturing machine elements such as balls, rivets and the like, especially machine elements with relatively small diameter such as balls having a diameter of 1 mm, from wire sections which differ from heretofore known presses of the general type involved by a considerably higher output, simplified construction and a faster and easier adjustment of the tools.

These and other objects and advantages of the invention will appear more clearly from the following specification in connection with the accompanying drawings, in which:

FIG. 7 represents a section taken along the line 7—7 of FIG. 5.

FIG. 8 shows the region of a matrix of the press according to FIG. 1 and represents a section taken along the line 8—8 of FIG. 1.

FIG. 9 shows a section of FIG. 8 but on a considerably larger scale than the latter.

Figures 1, 2:
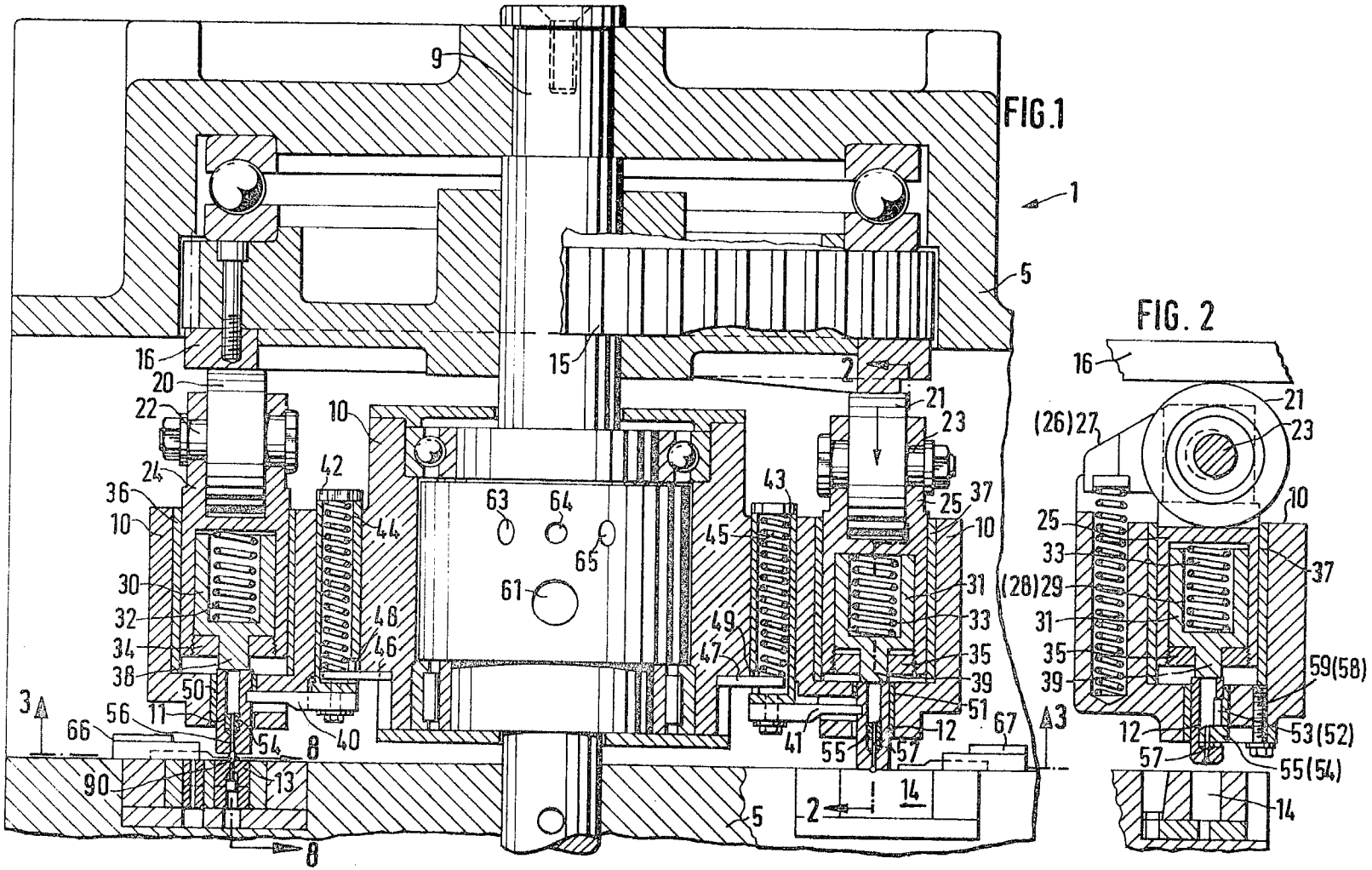
FIG. 1 is a top view of a press according to the invention.
FIG. 2 is a section taken along the line 2—2 of FIG. 1.
Figures 3, 4:
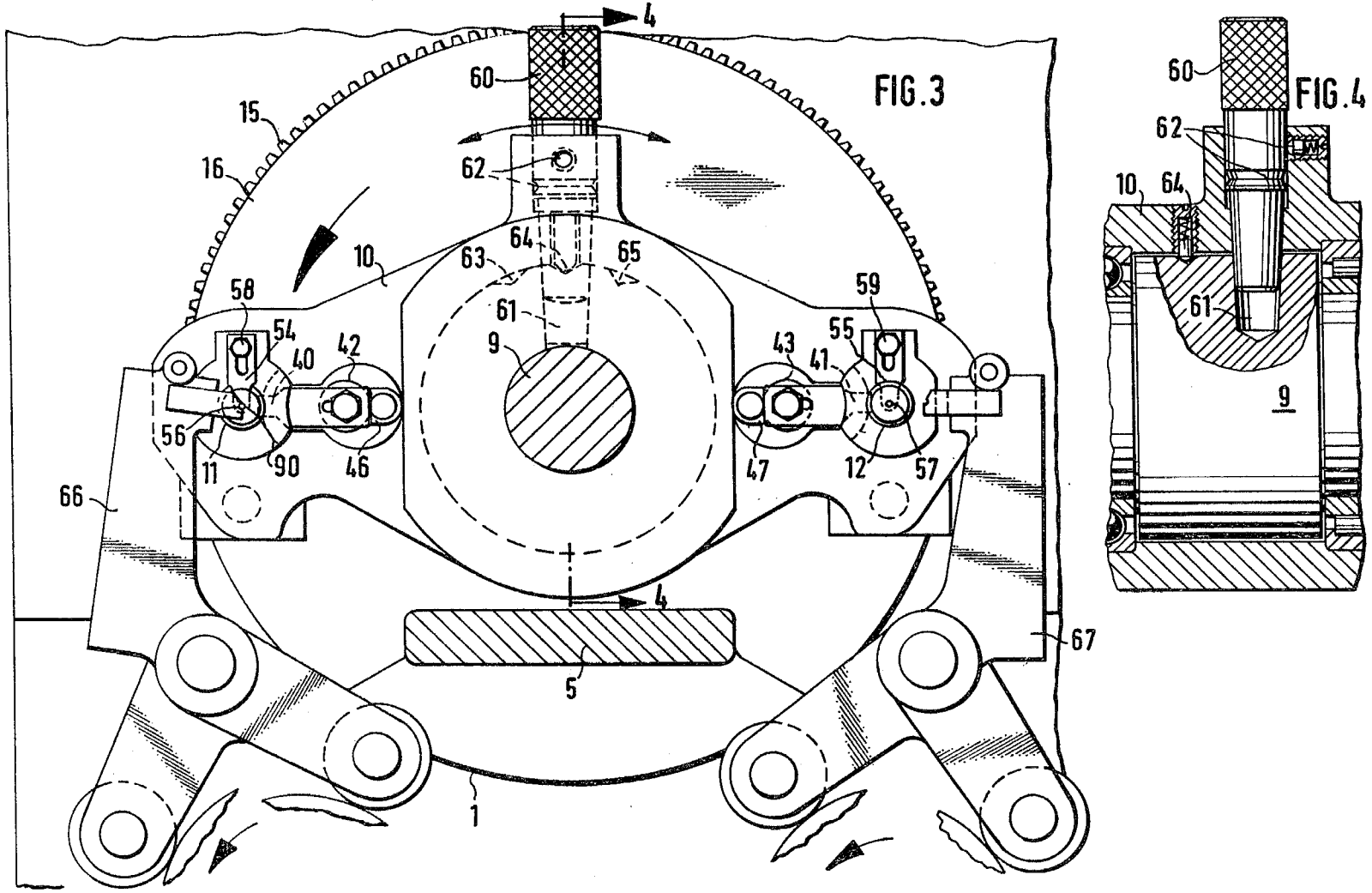
FIG. 3 is a section taken along the line 3—3 of FIG. 1 showing a front view of the press according to the invention.
FIG. 4 is a section along the line 4—4 of FIG. 3.
Figure 6:
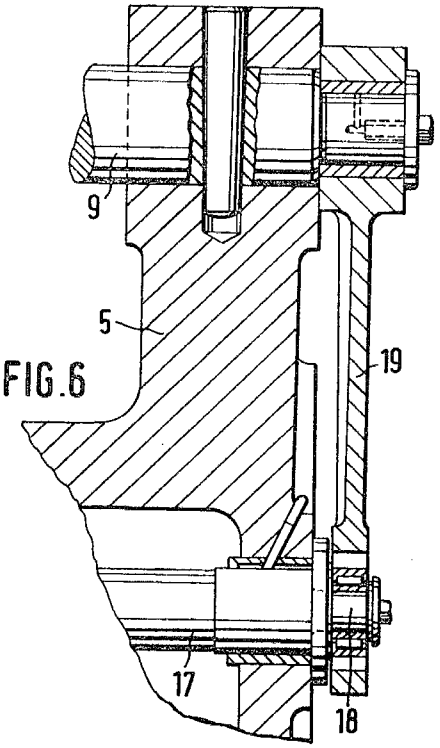
FIG. 6 is a section taken along the line 6—6 of FIG. 5.

The press according to the present invention is characterized primarily in that the punch is in axial direction with regard to the matrix movably guided in a tool carrier which is stationarily mounted in pressing direction in the machine frame 5 and is drivingly connected to a rotatable cam disc through the intervention of a pick-up roller.

The press according to the present invention has the advantage that only small moved masses are involved because with this press, the press carriage is in contrast to heretofore known presses discarded. Furthermore, the particular design of the drive of the pressing tools by means of a cam disc makes possible certain staying periods of the punch ahead of the matrix so that considerably more time than heretofore will be available for the return movement of the transporting device for the wire sections and the return movement of the shearing device taking over the transport of the wire sections, out of the range of movement of the punch. In addition thereto, with this press it is merely necessary to move the transporting device for the wire sections and for the shearing device out of the range of the relatively small punch and not as is the case with heretofore known presses out of the range of the considerably greater press carriage. Furthermore, any expert in the field will be able with this press according to the invention to set the tools for a manufacturing process in a relatively short time.

In contrast to the above mentioned method of making balls by shearing or cutting off of wire sections, rolling, rough grinding, hardening, honing and polishing, the employment of the press according to the invention brings about considerably saving in material because the volume of the upset or pressed ball and thus of the corresponding wire section, with the employment of the press according to the invention requires only about 1.7 times the volume of the finished ball whereas with the heretofore known pieces and methods of which volume requires 2.8 times the volume of the finished ball. In addition thereto, considerable time is saved during the production, and the rolling and rough grinding tools suffer from considerably less wear. The press according to the present invention may be so designed that it has only a single punch and a matrix associated with said punch. Preferably, however, a plurality, for instance two pairs of tools formed by the punch and matrix are provided and are distributed over the circumference of the cam disc for the drive of the punch or punches. Such structural design of a press according to the invention can be realized and correspondingly increases the output of the press.

A preferred structural design of the press according to the invention is characterized in that the punch of the tool is mounted on the circumference of a tool carrier which is arranged on a carrier axle fixedly connected to the machine frame, said carrier axle also being the support for the rotatable cam disc.

According to the invention it is furthermore suggested that the cam disc is designed as a cup wheel and that the pick-up rollers, through intermediate members transmitting a rectilinear power transmission communicate with the respective punch in driving connection.

According to a further development of the invention, a pick-up roller is rotatable about an axis of rotation which extends transverse to the pressing direction and intersects the axis of rotation of said cup wheel, said pick-up roller being rotatably journalled on one end of a push rod which is displaceably mounted in the tool carrier and is displaceable against the thrust of the spring in axial direction with regard to the associated matrix. The other end of said push rod engages an associated punch.

A further improvement of the press according to the invention is obtained when at that end of the push rod which faces away from the pick-up roller there is mounted in said push rod a sleeve which is displaceable relative to the push rod to a predetermined extent and against the pressing direction and against the spring force. This sleeve comprises an extension at that end which faces away from the pick-up roller while the punch engages said extension. This brings about that with a corresponding design of the cam surface of the cam disc provided for driving the punch, wire sections are kept prior to the pressing operation between the punch and the matrix for a predetermined time in order that the transporting device and the shearing off device will have sufficient time for returning from the region of the punch and of the matrix.

If the mentioned push rod and the mentioned sleeve are not rigidly connected to the punch, it is expedient that the punch is engaged by a spring loaded return finger which is mounted on the tool carrier and is displaceable in the pressing direction. In this way, a continuous contact between the push rod and the sleeve and punch will be assured. This can be realized by fixedly connecting the return finger to a slidable sleeve which is displaceable in the pressing direction and is mounted in the tool carrier, and in which a pressure spring is arranged which on one hand rests on that end of the displaceable sleeve which faces away from the return finger and on the other hand rests against an abutment which is fixedly connected to the tool carrier and extends through an opening in the slidable sleeve.

In order to maintain the pick-up roller in contact with the rotating cam disc, it is expedient that the push rod has an extension against which a pressure spring rests which in its turn rests against the tool carrier.

For purposes of obtaining a simple and compact design of a press according to the invention, it is furthermore suggested that the cam disc designed as cup wheel and serving for driving the punch or punches is nonrotatably connected to a gear mounted on the carrier axle. The said gear may be drivingly connected to a motor through further gears.

Furthermore, it is expedient that the punch has an ejection needle which is fixedly connected to a receiving plate which extends through a slot in the punch and is fixedly connected with the tool carrier.

In order to make the pressing tools, especially the punch, easily accessible, it is suggested that the tool carrier is journalled on the carrier axle and is pivotal by a predetermined angle. The tool carrier is adapted through a conical pin or the like which is longitudinally displaceably guided in the tool carrier, to be fixedly connected to the carrier axle. After removal of said conical pin from the region of the carrier axle, the tool carrier can be pivoted to such an extent that one or the other of the two punches, in case there are a total of two punches provided on the tool carrier, is easily accessible.

In this connection it may expedient that arresting means are provided for limiting the movement of the conical pin and the tool carrier.

In addition to the ejection needle which may be provided for a punch, it is suggested that for actuating ejector pins on the side of the matrix, the ejector lever provided for this purpose is mounted on a carrier axle which also forms the mounting place for the tool carrier and the cam disc.

It is furthermore advantageous that the ejector coulisses which are provided for obtaining the ejecting movement of the ejector punch, are adjustable parallel to the axis of the matrix.

It is furthermore advantageous to so dimension the openings provided in the ejecting lever for the arrangement of the ejector coulisse that in case of need, after removal of the ejector coulisses, the respective ejector pins can be removed through said openings.

For catching the pressed workpieces, it is suggested that in the space between the matrix and the associated punch there is provided a catching container for pressed workpieces. This container has an outlet opening located in the vicinity of the bottom, and in the upper region comprises a recess adapted to the con ours of the punch, through which recess the front region of the punch is movable.

Figure 5:
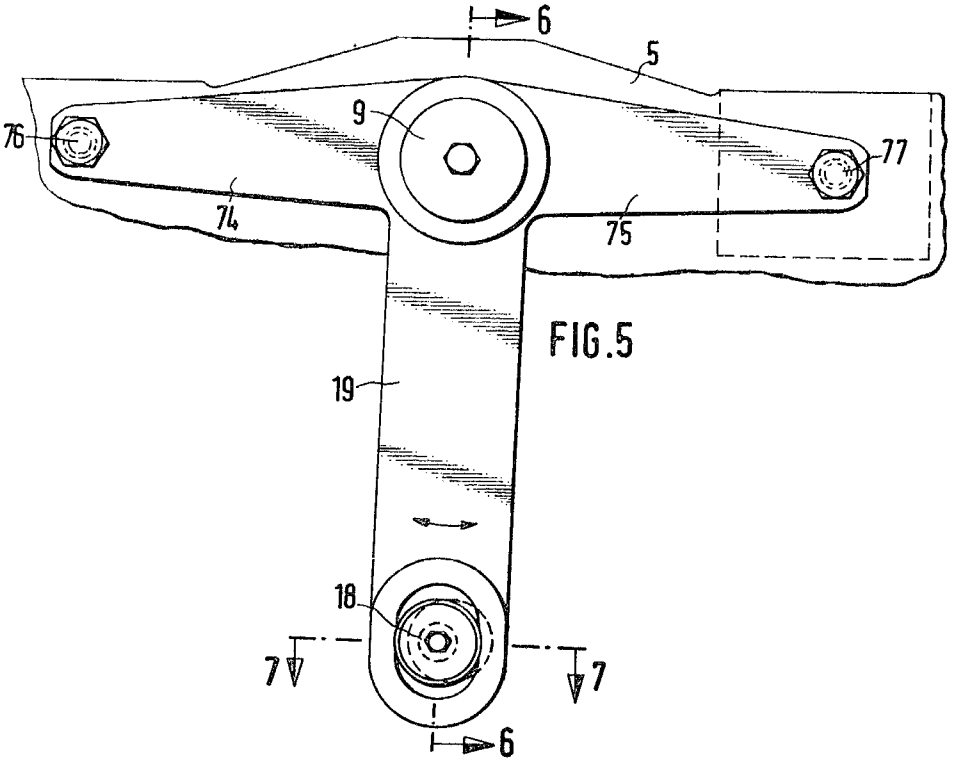
FIG. 5 shows a front view of an ejection lever for the press according to FIGS. 1-4.

Referring now to the drawings in detail, the press generally designated 1 comprises a machine body 5 in which in addition to the matrices 13 and 14 there is fastened a carrier shaft 9 which supports a tool carrier with punches 11 and 12. Furthermore, a gear 15 is rotatably journalled on the carrier shaft 9. Gear 15 is nonrotatably connected to a cam disc (cup wheel) 16. The gear 15 is through a further gear with the same number of teeth (not illustrated) drivingly connected to a motor. This gear is located below the gear 15 in FIG. 1 and is nonrotatably connected to a drive shaft 17 which through an eccentric 18 is drivingly connected to an ejector level 19 pivotally mounted on the carrier shaft 9 (see FIG. 5). Pick-up rollers 20 and 21 which by means of bolts 22 and 23 are rotatably journalled on one end of a push rod 24, 25 engage the cam disc 16. The axes of rotation of the pick-up rollers 20 and 21 extend perpendicular to the pressing direction or to the axis of rotation of the cam disc 16 and intersect this axis of rotation. The push rods 24 and 25 are each provided with an extension 26 and 27 on which respectively rests one end of a pressure spring 28, 29, while the other end respectively rests on the tool carrier 10.

In an opening located in the push rod 24 and 25 there is provided a sleeve 30, 31. The sleeve 30,31 is arranged in the push rod 24, 25 and is displaceable in pressing direction by a predetermined extent. Sleeve 30, 31 is under the influence of a pressure spring 32, 33 respectively. On that side of the push rods 24, 25 which faces away from the pick-up rollers 20,21 the push rods 24 and 25 are closed off by a disc 34, 35 respectively which are provided with a thread so that the possibility of movement of the sleeve 30, 31 in pressing direction is limited by said discs 34, 35.

The push rod 24 and the push rod 25 are respectively guided in a bushing 36, 37 in pressing direction, said bushings being connected to the tool carrier 10.

An extension 38, 39 extends through an opening (not designated) in disc 34, 35 respectively. These extensions 38,39 are respectively located on that side of sleeves 30, 31 which respectively face away from the pick-up rollers 20, 21. That end of the punches 11 and 12 which faces away from matrices 13 and 14 respectively is pressed by spring force against said extensions 38, 39 respectively. This spring force is introduced into the punches 11, 12 respectively through the intervention of returning fingers 40, 41 respectively. The returning fingers 40, 41 are respectively firmly connected to slide sleeves 42, 43 which are mounted in the tool carrier 10 and displaceable in pressing direction. Respectively arranged in sleeves 42 and 43 are pressure springs 44, 45 having one end respectively resting on that end of the sleeve 42, 43 which face away from the return fingers 40, 41 while the other ends of said pressure springs 44, 45 rest against abutments 46, 47 respectively which abutments are firmly connected to the tool carrier 10. The abutments 46, 47 respectively extend through cutouts 48, 49 in said sleeves 42, 43 and into the interior of the sliding sleeves.

The punches 11, 12 respectively displaceable in bushings 50, 51 connected to the tool carrier 10 are provided with a slot 52, 53 respectively through which a receiving plate 54, 55 for an ejector needle 56, 57 extends into the hollow inner chamber of the respective punch. Receiving plates 54, 55 and pertaining ejector needles 56, 57 are respectively firmly connected to each other. Those ends of the receiving plate 54, 55 which respectively face away from the pertaining ejector needles are, for instance, by means of screws 58, 59 respectively firmly connected to the tool carrier 10 so that the punches 11 and 12 will whenever necessary easily be accessible. The tool carrier 10 is displaceably connected to the carrier shaft 9 in such a way that after loosening a firm connection, a certain pivoting of the tool carrier 10 in one or the other direction of rotation will be possible. To this end, a conical pin 60 is provided which in case of a firm connection between tool carrier 10 and carrier shaft 9 (see FIG. 7) extends into a bore provided in the carrier shaft 9. After disengaging the conical pin 60 or after pulling out the conical pin 60 from bore 61 in carrier shaft 9 to a sufficient extent, the tool carrier 10 can by means of said conical pin 60 be pivoted on the carrier shaft 9. In order to limit the movement of the conical pin 60 in the direction out of the bore 61, and also in order to limit the pivotal movement of the workpiece carrier 10 in one or the other direction of rotation, arresting means 62,63, 64 and 65 are provided.

Within the region of the matrices 13 and 14, furthermore a combined shearing and transporting device 66, 67 is provided. Such devices are well known in the art so that they do not have to be described in detail.

For controlling the ejector pins 68 and 69 as well as the ejector needle 72 or for controlling the ejector pins 70, 71 as well as the ejector needle 73, which are associated with the matrices 13, 14 respectively, ejector coulisses 76, 77 are respectively arranged in the arms 74, 75 of the ejector lever 19. The opening provided for the arrangement of the ejector coulisses 76, 77 in arms 74, 75 respectively of the ejector lever 19 are expediently so dimensioned that after removal of the respective ejector coulisses the opening freed by said coulisses is accessible through the respective ejector pins and ejector needles.

From FIG. 9 it will be seen that the ejector pins 69, 71 respectively adjacent the ejector pins 68, 70 have a far shorter diameter than the ejector pins 68, 70 respectively. The ejector pins 69, 71 are respectively guided in sleeves 78, 79 which are under the effect of pressure springs 80, 81. In the bore of sleeves 78, 79 in which respectively the ejector pins 69, 71 are guided, there are provided collars 82, 83 of the ejector needles 72, 73 respectively. The collars 82, 83 are located on that side of the ejector pins 69, 71 which face away from the ejector pins 68,70 respectively. The front end of the ejector needles 72, 73 is respectively guided in the matrices 13, 14.

In the space between the matrices 13, 14 and the punches 11, 12, there are arranged catching containers 84, 85 for the pressed workpieces which containers have an outlet opening located in the vicinity of the bottom and which in the upper region comprise cutouts 88, 89 which are adapted to the contours of the punches 11, 12 respectively and through which are movable the front regions of the punches 11 and 12 respectively.

The operation of the press according to FIGS. 1–9 is as follows: The gear 15 is rotatably driven by a motor. Accordingly, also the cam disc (cup wheel) 16 nonrotatably connected to gear 15, rotates accordingly. The cam disc 16, through the pick-up rollers 20 and 21 controls the push rods 24, 25 as well as the sleeves 30, 31 and the punches 11 and 12. The extension of the curved path of the cam disc 16 is expediently so designed that the punches 10, 12 will for a predetermined time period prior to a pressing operation be held in a position as it is illustrated for the punch 11, in FIG. 1. In this position of the pressing punch 11, the punch 11 corresponding to the tension of the pressure spring 32 presses a wire section 19 against the pertaining matrix 13. This time period is so selected that the shearing off and transporting device 66, 67 will have sufficient time for the return movement out of the region of the punches 11, 12. Subsequently to the effected return movement of the shearing off and transporting devices 66, 67, the pressing of the wire section 90 is effected.

After the pressing of a wire section 90 to form a ball-like workpiece, this workpiece drops into the catching container 84, 85 after the workpiece has been previously ejected by means of ejector needles 56, 57 in the punches 11, 12 respectively, or by means of the ejector needles 72, 73 in the matrices 13, 14 respectively. If ejector needles 56, 57 are employed, the relative movement between ejector needles 56, 57 and punches 11, 12 respectively is used for the ejection process.

The punch 12 is in FIG. 1 shown in its pressing position in which the punch 12 engages the extension 39 of sleeve 31 which in its turn directly engages the push rod 25. In conformity with the cycle of the actuation of the punches 11 and 12 by the pick-up roller 20, 21 through the intervention of the cam disc 16, also the ejector lever 19 pivotally mounted on the carrier shaft 9 is pivotally driven by means of the eccentric 18 arranged on the drive shaft 17. As a result thereof, through ejector coulisses 76, 77 alternately the ejector pins and ejector needles are actuated which are associated with the matrices 13 and 14.

Instead of the embodiment of the invention as illustrated in the drawing, it is also possible to provide more than two press stations or only one single press station. Furthermore, it is possible to operate the press according to the invention also according to the double press system instead of the single press system. For controlling two punches associated with one matrix, it is possible through the intervention of a control cross or the like to take advantage for instance of the movement effected in pressing direction of the push rods supporting the pick-up rollers.

It is, of course, to be understood that the present invention is, by no means, limited to the specific showing of the drawings, but also comprises any modifications within the scope of the appended claims.

I claim:

1. A press for producing machine elements of relatively small dimensions, especially balls and rivets, from wire sections, in which wire sections are transported to a stationary matrix, said press including in combination: a machine frame, a tool carrier stationarily arranged in said machine frame, matrix receiving means associated with said machine frame for receiving at least one matrix, a rotatable cam disc, driving means arranged in said machine frame for rotating said cam disc, actuating roller means operable by said cam disc, and reciprocable punch means axially movably guided by said tool carrier for cooperation with a matrix in said matrix receiving means, said punch means being drivingly operable by said cam disc through the engaging intervention of said actuating roller means, intermediate members operable to effect a rectilinear power transmission and said cam disc being cup wheel shaped and said actuating roller means being drivingly connected through said intermediate members with the pertaining punch means, a plurality of push rods corresponding in number to the number of said actuating roller means, and each of said actuating roller means being respectively rotatable about a pin supported by the respective push rod and having its axis of rotation extend in a direction transverse to the axis of rotation of said cup wheel shaped cam disc, each of said push rods at one end supporting an actuating roller means by means of the pertaining pin and at its other end being operable to engage the respective adjacent punch means, each of said push rods being arranged in said tool carrier and being displaceable therein against the thrust of a spring and axially with regard to the pertaining matrix receiving means, each of said push rods having a cavity with an opening in alignment with the adjacent punch means and located on that side of said push rod which is remote from the pertaining actuating roller means, a cup-shaped sleeve member reciprocable in said cavity and open at that end which is adjacent the pertaining actuating roller means and closed at the opposite end with the exception of a passage therethrough, and spring means arranged in said cavity and continuously urging said sleeve member in the direction toward the respective adjacent matrix receiving means, said sleeve member being provided with an extension extending through said last mentioned passage into operative engagement with the pertaining punch.

2. A press according to claim 1, which includes spring loaded return fingers respectively associated with said punches for returning said punches from the end of their punching stroke to their starting position, said return fingers respectively being displaceable in the direction toward said matrix receiving means.

3. A press according to claim 2, which includes slidable sleeves respectively fixedly connected to said return fingers and displaceably mounted in and substantially parallel to the axis of said tool carrier, compression springs respectively arranged in said slidable sleeves, each of said slidable sleeves having a passage therethrough near that end thereof which is adjacent the pertaining return finger, a first spring abutment at that end of each slide sleeve which is remote from its pertaining return finger, and second spring abutments respectively arranged at that end of each slidable sleeve which is adjacent the pertaining return finger, said second spring abutments being fixedly connected to said tool carrier and respectively extending through the passage of the pertaining slidable sleeve and abutting the adjacent end of the pertaining compression spring.

4. A press for producing machine elements of relatively small dimensions, especially balls and rivets, from wire sections, in which wire sections are transported to a stationary matrix, said press including in combination: a machine frame, a tool carrier stationarily arranged in said machine frame, matrix receiving means associated with said machine frame for receiving at least one matrix, a rotatable cam disc, driving means arranged in said machine frame for rotating said cam disc, actuating roller means operable by said cam disc, and reciprocable punch means axially movably guided by said tool carrier for cooperation with a matrix in said matrix receiving means, said punch means being drivingly operable by said cam disc through the engaging intervention of said actuating roller means, intermediate members operable to effect a rectilinear power transmission and said cam disc being cup wheel shaped and said actuating roller means being drivingly connected through said intermediate members with the pertaining punch means, a plurality of push rods corresponding in number to the number of said actuating roller means, and each of said actuating roller means being respectively rotatable about a pin supported by the respective push rod and having its axis of rotation extend in a direction transverse to the axis of rotation of said cup wheel shaped cam disc, each of said push rods at one end supporting an actuating roller means by means of the pertaining pin and at its other end being operable to engage the respective adjacent punch means, each of said push rods being arranged in said tool carrier and being displaceable therein against the thrust of a spring and axially with regard to the pertaining matrix receiving means, each of said push rods having an extension and a compression spring on one hand resting against said extension and on the other hand resting against said tool carrier.

5. A press according to claim 4, in which said driving means includes a gear drivingly connectable to a motor and rotatably mounted on said carrier shaft, and in which said cup wheel shaped cam disc is drivingly connected to said gear.

6. A press according to claim 4, in which each punch has a slot and an ejector pin, and in which a receiving member is fixedly connected to said ejector pin, said receiving member extending through said last mentioned slot and being fixedly connected to said tool carrier.

7. A press according to claim 4, in which said tool carrier is mounted on said carrier shaft so as to be pivotable thereabout by a predetermined angle, and in which a conical pin is longitudinally displaceable in said tool carrier and fixedly connectable to said carrier shaft.

8. A press according to claim 7, which includes arresting means provided for limiting the movement of said conical pin and said tool carrier.

9. A press according to claim 4, in which said cam disc has distributed over its circumference a plurality of punches forming said punch means and a corresponding number of matrix receiving means.

10. A press according to claim 4, which includes a carrier shaft firmly connected to said machine frame and rotatably supporting said cam disc, said punch means being arranged on the circumference of said tool carrier.

11. A press for producing machine elements of relatively small dimensions, especially balls and rivets, from wire sections, in which wire sections are transported to and in front of a matrix, said press including: a machine frame, a tool carrier which in pressing direction of said press is stationarily mounted in said machine frame, said machine frame being provided with matrix receiving means, punch means movably guided in said tool carrier in axial direction with regard to said matrix receiving means, a rotatable cam disc, driving means arranged in said machine frame for rotating said cam disc, actuating roller means operable by said cam disc to actuate said push means, said driving means including a first gear fixedly connected to said cam disc, a second gear drivingly connected to said first gear, motor means drivingly connected to said second gear, a drive shaft drivingly connected to said second gear and having a free end, an eccentric connected to said free end, an ejector lever drivingly connected to said drive shaft through the intervention of said eccentric, said ejector lever being located in a plane perpendicular to the pressing direction of said punch means being pivotally arranged in said machine frame, and ejector slide block means supported by said ejector lever and corresponding in number to the number of said punch means, and ejector pins, said ejector slide block means respectively being drivingly connected to said ejector pins for ejecting workpieces from matrices in said matrix receiving means.

12. A press according to claim 11, which includes a carrier shaft firmly connected to said machine frame and rotatably supporting said cam disc, and a tool carrier stationarily arranged in said machine frame and in which said ejector lever and said tool carrier and said cam disc are mounted on said carrier shaft.

13. A press according to claim 11, in which said ejector slide block means are adjustable substantially parallel to the axis of said matrix receiving means.

14. A press according to claim 11, in which said ejector lever has openings for arranging ejector slide block means, said openings being of sufficient size to permit withdrawal of the pertaining ejector pins therethrough after removal of said ejector slide block means.

15. A press according to claim 11, which includes collecting container means associated with said matrix receiving means for collecting pressed workpieces, said collecting container means having a bottom and a discharge opening provided in the vicinity of said bottom, the upper region of said collecting container means having a cutout corresponding to the contour of said punch means so as to permit movement of the front portion of said punch means therethrough.

* * * * *